US008922130B2

(12) United States Patent
Naruo et al.

(10) Patent No.: US 8,922,130 B2
(45) Date of Patent: Dec. 30, 2014

(54) SOLID-STATE LIGHT-EMITTING ELEMENT DRIVE DEVICE, LIGHTING SYSTEM AND LIGHTING FIXTURE

(71) Applicant: Panasonic Corporation, Osaka (JP)

(72) Inventors: Masahiro Naruo, Osaka (JP); Sana Esaki, Osaka (JP); Kenichi Fukuda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/016,623

(22) Filed: Sep. 3, 2013

(65) Prior Publication Data

US 2014/0070721 A1 Mar. 13, 2014

(30) Foreign Application Priority Data

Sep. 7, 2012 (JP) ..... 2012-197868

(51) Int. Cl.
*H05B 33/08* (2006.01)

(52) U.S. Cl.
CPC ..... *H05B 33/0821* (2013.01); *H05B 33/0851* (2013.01)
USPC ..... 315/224; 315/186; 315/209 R; 315/291; 315/307

(58) Field of Classification Search
USPC ..... 315/186, 209 R, 224, 225, 291, 307
See application file for complete search history.

(56) References Cited

U.S. PATENT DOCUMENTS

| | | | | |
|---|---|---|---|---|
| 7,071,762 | B2 | 7/2006 | Xu et al. | |
| 7,667,408 | B2 * | 2/2010 | Melanson et al. | 315/209 R |
| 8,773,032 | B2 * | 7/2014 | May et al. | 315/224 |
| 2003/0085749 | A1 | 5/2003 | Xu et al. | |
| 2010/0033146 | A1 * | 2/2010 | Irissou et al. | 323/282 |
| 2012/0223649 | A1 * | 9/2012 | Saes et al. | 315/186 |
| 2012/0262082 | A1 * | 10/2012 | Esaki et al. | 315/224 |
| 2012/0262087 | A1 * | 10/2012 | Watanabe et al. | 315/291 |

(Continued)

FOREIGN PATENT DOCUMENTS

| | | | |
|---|---|---|---|
| JP | 2006-511078 | A | 3/2006 |
| JP | 2012-014965 | A | 1/2012 |
| JP | 4901104 | B | 1/2012 |
| JP | 2012-023277 | A | 2/2012 |
| JP | 2012-084334 | A | 4/2012 |
| JP | 2012-104367 | A | 5/2012 |

*Primary Examiner* — Thuy Vinh Tran
*Assistant Examiner* — Syed M Kaiser
(74) *Attorney, Agent, or Firm* — Renner, Otto, Boisselle & Sklar, LLP

(57) ABSTRACT

In a conventional example, even if a duty cycle of the burst dimming is changed during an OFF-period of a switching element, current flowing to an LED is maintained constant. On the other hand, in the present embodiment, an accumulated value of ON-periods of a switching element is increased or decreased so as to be linked to a minimum variation width for a duty cycle (a dimming level) of a dimming signal, regardless of a timing of when the duty cycle is changed. Therefore, a lighting system (an LED drive device) according to the present embodiment can change smoothly a light output of a solid-state light-emitting element (a light source) with respect to a change in a duty cycle of the burst dimming while preventing the switching frequency from increasing.

11 Claims, 5 Drawing Sheets

(56) References Cited

U.S. PATENT DOCUMENTS

2012/0313529 A1* 12/2012 Chen et al. ..... 315/121
2013/0193879 A1* 8/2013 Sadwick et al. ..... 315/307
2013/0214697 A1* 8/2013 Archenhold ..... 315/291
2013/0249431 A1* 9/2013 Shteynberg et al. ..... 315/287
2013/0264964 A1* 10/2013 Luo et al. ..... 315/289
2013/0293139 A1* 11/2013 Sadwick et al. ..... 315/224
2014/0077719 A1* 3/2014 Fukuda et al. ..... 315/224
2014/0217913 A1* 8/2014 Heeringa ..... 315/209 R

* cited by examiner

DIMMING SIGNAL
DRIVE SIGNAL
INDUCTOR CURRENT
ILp
PERIOD Tx FOR BURST DIMMING
Ton (1)
Ton (2)
Ton (3)
Ta
Tb

SOLID-STATE LIGHT-EMITTING ELEMENT DRIVE DEVICE, LIGHTING SYSTEM AND LIGHTING FIXTURE

BACKGROUND OF THE INVENTION

1. Field of the Invention

The invention relates generally to solid-state light-emitting element drive devices, lighting systems and lighting fixtures and, more particularly, to a solid-state light-emitting element drive device that drives a solid-state light-emitting element, such as a light-emitting diode or an organic electroluminescence (EL) element, to emit light, and a lighting system and a lighting fixture that use the drive device.

2. Description of the Related Art

In recent years, a lighting system and a lighting fixture have rapidly become widely used, which adopts, as a light source, a solid-state light emitting element such as a light-emitting diode or an organic electroluminescence (EL) element, as substitute for an incandescent lamp and a fluorescent lamp. For example, Japanese Unexamined Patent Application Publication (Translation of PCT Application) No. 2006-511078 discloses an LED drive device that adopts, as a light source, a light-emitting diode (LED) and adjusts (dims) amount of light outputted from the LED by increasing or decreasing output of a switching source circuit (a step-down chopper circuit) in response to a dimming signal provided by a dimmer.

Here, as a dimming method of an LED, there are a dimming method in which a magnitude of current continuously flowing to the LED is changed (hereinafter, referred to as a DC (Direct Current) Dimming Method), a dimming method in which a ratio of a conducting period (a duty cycle) is changed by periodically switching on and off the current flowing to an LED (hereinafter, referred to as a Burst Dimming Method), and the like. The latter Burst Dimming Method is adopted in the conventional LED drive device described in the above-mentioned document.

However, the conventional LED drive device that adopts the Burst Dimming Method has the problem that causes interference with video equipment, such as a video camera, thereby generating flicker. This is caused by a difference between a period of the burst dimming and a shutter speed (an exposure time) of the video equipment, and therefore, the flicker (variation in brightness) or streaky contrasting density appears on an image generated by the video equipment. In addition, a repetition frequency of a light output is required to be more than or equal to 500 Hz, according to enforcement of amendment to technical standards in Electrical Appliance and Material Safety Law (Japanese Laws) relating to an LED (standards in paragraph 1 of the Ministerial Ordinance that establishes technical standards in Electrical Appliances: Amendments of the Ministerial Ordinance on Jan. 13, 2012).

Incidentally, in a general step-down chopper circuit, when current flowing through an inductor reaches a threshold value during an ON-period of a switching element, the switching element is turned off at that timing, and then when a regenerative current reaches a lower limit (e.g., zero), the switching element is turned on again at that timing. Therefore, when a frequency of a burst signal is adapted to the above-mentioned technical standards, the following problem is generated with combination of the step-down chopper circuit and the drive device: even if the duty cycle of the burst signal is changed during an OFF-period of the switching element in the step-down chopper circuit, the inductor current does not change (See FIG. 5A), and as a result, it means that the light output of the LED changes along a tiered line with respect to a change in the duty cycle of the burst signal, as shown in FIG. 5B.

Here, a light output for each tier in FIG. 5B corresponds to a light output for a single period in the switching periods of the switching element. Therefore, if the switching periods of the switching element are shortened (if the switching frequency is increased), the light output for each tier reduces, thereby allowing the overall light output to change more linearly. However, increasing the switching frequency leads to an increase in the switching loss, and further when considering the performance of the drive circuit driving the switching element, making significantly higher frequency can't be expected.

SUMMARY OF THE INVENTION

It is an object of the present invention to provide a solid-state light-emitting element drive device, which can change smoothly a light output of a solid-state light-emitting element with respect to a change in a duty cycle of the burst dimming while preventing the switching frequency from increasing, and a lighting system and a lighting fixture using the same.

A solid-state light-emitting element drive device of one aspect of the invention comprises: a switching source circuit in which a solid-state light-emitting element is connected between output terminals of the switching source circuit, the switching source circuit comprising a switching element; and a control circuit configured to control switching operation of the switching element of the switching source circuit, and wherein the switching source circuit further comprises an inductor and a regenerative element, the switching element and the inductor constituting a series circuit, the regenerative element configured to make a regenerative current flow from the inductor, when the switching element is turned off, wherein the control circuit comprises a microcomputer, the control circuit configured to turn on the switching element in response to an ON-period of a drive signal outputted from the microcomputer, the control circuit configured to turn off the switching element in response to an OFF-period of the drive signal, the control circuit configured to interrupt periodically output of the switching source circuit to adjust an average value of current flowing to the solid-state light-emitting element to a value corresponding to a dimming level instructed from outside, and wherein the control circuit is configured to perform the switching operation of the switching element during a conducting period, the control circuit being configured to stop the switching operation of the switching element during a stop period following the conducting period, the control circuit being configured to alternately repeat the conducting period and the stop period, while increasing or decreasing the conducting period and the stop period in response to the dimming level, the control circuit being configured to adjust an accumulated value of ON-periods of the drive signal within the conducting period, in response to the dimming level, and to set a minimum variation width for the conducting period to be shorter than the ON-period.

In the solid-state light-emitting element drive device, preferably, the control circuit monitors the accumulated value of the ON-periods, the control circuit stopping the switching operation of the switching element when the accumulated value reaches a target value.

In the solid-state light-emitting element drive device, preferably, the control circuit estimates the accumulated value from at least one of the ON-periods.

In the solid-state light-emitting element drive device, preferably, the control circuit estimates the accumulated value from an initial ON-period of the ON-periods in the conducting period.

In the solid-state light-emitting element drive device, preferably, the control circuit further comprises: a burst signal generation unit configured to generate a burst signal in which a ratio between the conducting period and the stop period is variable, the burst signal including a pulse signal with a constant period that is synchronized with the conducting period and the stop period; a PWM signal generation unit configured to generate a pulse-width modulation signal in which a period and a width of an ON-period thereof are variable, the pulse-width modulation signal having a frequency higher than the burst signal; a drive signal generation unit configured to calculate a logical AND of the burst signal and the PWM signal to generate a drive signal for driving the switching element; and an adjusting unit configured to adjust the ratio of the burst signal generated by the burst signal generation unit, based on the dimming level.

In the solid-state light-emitting element drive device, preferably, the adjusting unit calculates the ratio of the burst signal from an accumulated value of the ON-periods and OFF periods of the signal within the conducting period.

In the solid-state light-emitting element drive device, preferably, the adjusting unit estimates the accumulated value from at least one of the ON-periods and an OFF-period following at least one of the ON-periods.

In the solid-state light-emitting element drive device, preferably, the adjusting unit estimates the accumulated value from an initial ON-period and an initial OFF period following the initial ON-period in the conducting period.

In the solid-state light-emitting element drive device, preferably, the microcomputer have a timer built-in, the timer clocking the conducting period and the stop period.

A lighting system of one aspect of the invention comprises: any one of the above-mentioned solid-state light-emitting element drive devices; and a solid-state light-emitting element driven by the solid-state light-emitting element drive device.

A lighting fixture of another aspect of the invention comprises: any one of the above-mentioned solid-state light-emitting element drive devices; a solid-state light-emitting element driven by the solid-state light-emitting element drive device; and a fixture body holding the solid-state light-emitting element drive device and the solid-state light-emitting element.

The solid-state light-emitting element drive device, the lighting system and the lighting fixture of another aspect of the invention increase or decrease the accumulated value of the ON-periods of the switching element so as to be linked to a minimum variation width for the duty cycle regardless of a timing of a change in the duty cycle (dimming level) of the dimming signal for the burst dimming. Therefore, the solid-state light-emitting element drive device, the lighting system and the lighting fixture has the effect of changing smoothly a light output of the solid-state light-emitting element with respect to the change in the duty cycle of the burst dimming while preventing the switching frequency from increasing.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Hereinafter, embodiments will be explained, in which technical ideas of the present invention are adapted to: a solid-state light-emitting element drive device using an LED (a light-emitting diode) as a solid-state light-emitting element; a lighting system; and a lighting fixture. Here, the solid-state light-emitting element is not limited to an LED, and a solid-state light-emitting element, such as an organic electroluminescence (EL) element, except for the LED can be also adopted.

First Embodiment

Figure 2:
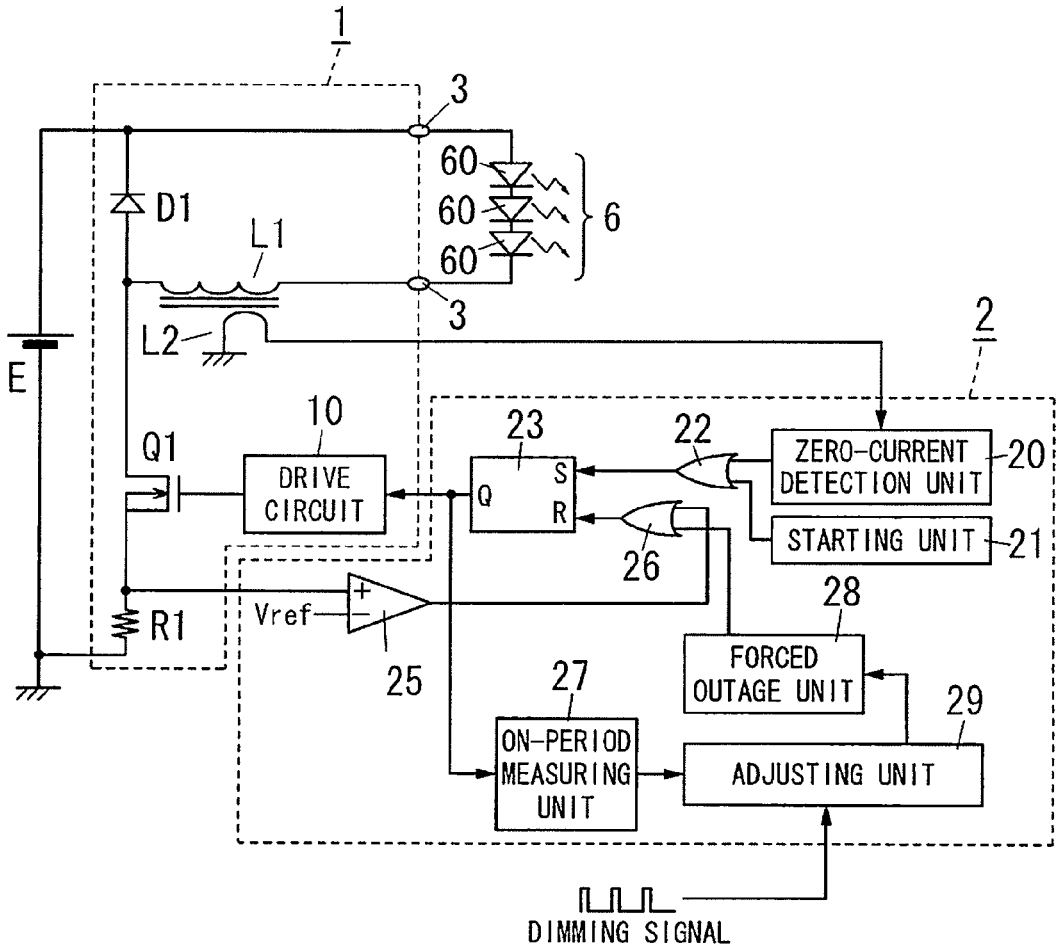
FIG. 2 is a circuit configuration diagram showing the solid-state light-emitting element drive device and the lighting system according to First Embodiment of the invention.

As shown in FIG. 2, a lighting system according to the present embodiment includes: a light source 6 configured by a series circuit in which a plurality of LEDs 60 are connected in series; and a solid-state light-emitting element drive device (hereinafter, referred to as an LED drive device). The LED drive device converts DC voltage/current supplied from a DC power source E to DC voltage/current for the light source 6 and drives (light) the light source 6.

The LED drive device according to the present embodiment includes a switching source circuit 1 and a control circuit 2. Then, the light source 6 is connected between output terminals 3 of the switching source circuit 1. The DC power source E applies DC voltage between input terminals of the switching source circuit 1. The switching source circuit 1 is a well-known step-down chopper circuit that includes a switching element Q1, a diode D1 (a regenerative element), an inductor L1, a drive circuit 10 and the like. The switching element Q1 includes a field-effect transistor in which the drain thereof is connected to an anode of the diode D1, and the source thereof is connected to a negative electrode of the DC power source E via a sensing resistor R1. The inductor L1 has one end that is connected to a connecting point of the anode of the diode D1 and the drain of the switching element Q1. The other end of the inductor L1 and a cathode of the diode D1 are respectively connected to the output terminals 3, 3. The inductor L1 is provided with a secondary winding L2 with one end connected to the circuit ground. The other end of the secondary winding L2 is connected to a zero-current detection unit 20 of the control circuit 2 as described below. The drive circuit 10 applies a bias voltage to the gate of the switching element Q1 to turn on it when a drive signal provided from the control circuit 2 is at a high level, and applies no bias voltage to turn off the switching element Q1 when the drive signal is at a low level.

The control circuit 2 includes a microcomputer that is equipped with a timer (a PWM timer 23) that generates a PWM (pulse-width modulation) signal, and provides, as the drive signal, an output signal (the PWM signal) of the PWM timer 23 to the drive circuit 10. In this case, the PWM timer 23 includes an RS flip-flop. That is, the switching element Q1 is turned on in response to an ON-period (a high-level period) of a signal (the drive signal) outputted from the microcomputer of the control circuit 2, and is turned off in response to an OFF-period (a low-level period) of the signal.

The control circuit 2 includes the zero-current detection unit 20 that detects a zero cross of an inductor current caused by a voltage induced at the secondary winding L2 and outputs a detection signal with a high level when detecting the zero cross. Further, the control circuit 2 includes a starting unit 21, a first OR gate 22, a comparator 25, a second OR gate 26, an ON-period measuring unit 27, a forced outage unit 28, an adjusting unit 29, and the like.

The starting unit 21 outputs a starting signal with a high level into the first OR gate 22 when the DC power source E starts applying DC voltage. The first OR gate 22 calculates a logical OR of the starting signal of the starting unit 21 and the detection signal of the zero-current detection unit 20, and then outputs a set signal into a set terminal of the PWM timer 23.

The comparator 25 compares a voltage (detection voltage) between both ends of the sensing resistor R1 with a reference voltage Vref, and then rises the output signal to the high level, when the current (inductor current) flowing during the ON-period of the switching element Q1 reaches a predetermined peak value and the detection voltage becomes more than or equal to the reference voltage Vref. The ON-period measuring unit 27 measures a high-level period (ON-period) per period of the drive signal that is outputted from the PWM timer 23, and outputs the measured value into the adjusting unit 29.

Figures 1A, 1B, 1C:
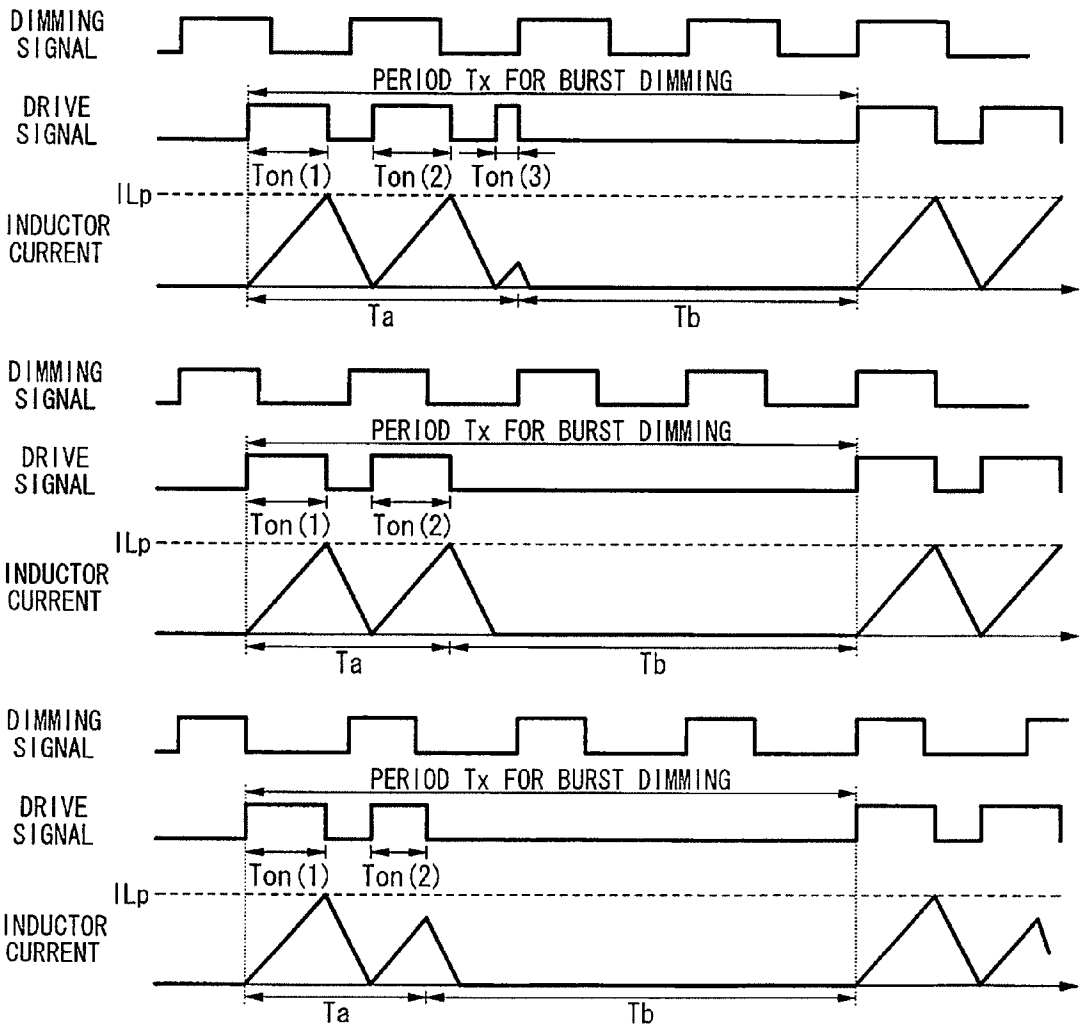
FIGS. 1A to 1C are waveform diagrams for explaining operations of a solid-state light-emitting element drive device and a lighting system according to First Embodiment of the invention.

The adjusting unit 29 accumulates the measured values within a conducting period (It is a time period during which the drive signal is being outputted from the PWM timer 23 and, that is, as shown in FIGS. 1A to 1C, it is a time period Ta during which the switching operation of the switching element Q1 is being performed). Then, the adjusting unit 29 outputs a trigger signal with a high level into the forced outage unit 28 when the accumulated value reaches a target value corresponding to a dimming level instructed from a dimmer (not shown). The forced outage unit 28 outputs, into the second OR gate 26, one-shot pulse signal that rises to a high level at a constant period while the trigger signal outputted from the adjusting unit 29 is at the high level. The second OR gate 26 calculates a logical OR of the output of the comparator 25 and the output (the one-shot pulse signal) of the forced outage unit 28, and resets the PWM timer 23 when at least one of those outputs rises to the high level. That is, the PWM timer 23 is periodically reset while the forced outage unit 28 outputs the one-shot pulse signal. Therefore, during that time, the drive signal is not outputted from the PWM timer 23 and the switching element Q1 is maintained in OFF-state. Here, the time during which the drive signal is not outputted from the PWM timer 23 (that is, as shown in FIGS. 1A to 1C, a time period Tb during which the switching element Q1 is maintained in OFF-state) is referred to as "a stop period".

The dimmer converts a dimming level corresponding to a position (turning position) of an operation knob one-to-one, for example into a duty cycle (a width of ON-period) of a pulse signal with a constant period, and then outputs, into the control circuit 2, a dimming signal as the pulse signal (the PWM signal). Here, a minimum variation width for the duty cycle of the dimming signal is set to be shorter than an ON-period of the switching element Q1 (a high-level period of the drive signal) upon a rated lighting. Operations according to the present embodiment will be explained. First, there is explained the case where the dimming level instructed by the dimming signal is set to 100%, that is, the rated lighting of the light source 6 is performed by supplying continuous output of the switching source circuit 1. When the detection signal of the zero-current detection unit 20 or the starting signal of the starting unit 21 is inputted to the first OR gate 22 and the set signal is outputted to the set terminal of the PWM timer 23, the drive signal is outputted from the PWM timer 23 and the switching element Q1 is turned on. When the switching element Q1 is turned on, the current (the inductor current) flows through the DC power source E, the light source 6, the inductor L1, the switching element Q1, the sensing resistor R1 and the DC power source E in this order. This inductor current increases linearly as shown in FIGS. 1A to 1C.

When the inductor current reaches the predetermined peak value, the output of the comparator 25 becomes the high level. Further, when the output of the second OR gate 26 becomes the high level, the PWM timer 23 is reset and the drive signal is stopped. As a result, the switching element Q1 is turned off and the energy stored in the inductor L1 is released, and therefore, the current (the inductor current) continuously flows to the light source 6 via the diode D1.

When all the energy stored in the inductor L1 has been released and the inductor current is reduced to zero, the detection signal is outputted from the zero-current detection unit 20, and thereby the set signal is outputted from the first OR gate 22 to the set terminal of the PWM timer 23. Hence, the drive signal is outputted from the PWM timer 23, and the switching element Q1 is turned on. In this way, the switching operation of the switching element Q1 is performed at a constant period (a switching period), and therefore, the switching source circuit 1 supplies a rated direct-current (an average value) to the light source 6.

Next, there is explained the case where the dimming level instructed by the dimming signal is set to less than 100%. In this case, the control circuit 2 interrupts periodically the output of the switching source circuit 1, thereby adjusting the average value of the current flowing to the light source 6 to a value corresponding to the dimming level. That is, the device according to the present embodiment adopts the Burst Dimming Method as the dimming method for the light source 6.

The adjusting unit 29 detects rising and falling of the dimming signal as the pulse signal, thereby measuring a width of an ON-period, a width of an OFF-period and a period thereof, and determining a dimming level in response to a duty ratio thereof. The adjusting unit 29 adjusts an ON-period Ton(k) of the switching element Q1 (where, k=1, 2, . . . , n) (actually adjusts the last ON-period) so that an accumulated value:

$$\text{"}\Sigma Ton(=Ton(1)+Ton(2)+\ldots+Ton(n))\text{"}$$

of ON-periods Ton(i) of the switching element Q1 within the conducting period matches a target value corresponding to the dimming level. Here, a memory in the microcomputer stores a plurality of target values respectively corresponding to a plurality of dimming levels which are included within a range of a lower limit (e.g., 5%) to an upper limit (e.g., 99%) in the burst dimming. In this case, the adjacent dimming levels are separated from each other by a minimum variation width. Hence, the adjusting unit 29 retrieves and obtains a target value corresponding to the dimming level instructed by the dimming signal, from the memory. Here, in a case where the minimum variation width for the dimming level is 1% for example, when the dimming level is changed from 50% to 51%, the conducting period also changes with the change of the dimming level. At that time, a width of a change in the conducting period is defined as a minimum variation width for the conducting period.

The adjusting unit 29 accumulates the measured values of the ON-periods Ton(1), Ton(2), . . . , Ton(n) measured by the ON-period measuring unit 27, and then outputs the trigger signal with the high level into the forced outage unit 28 when the accumulated value ΣTon reaches the target value retrieved and obtained from the memory. Here, the adjusting unit 29 stops outputting the trigger signal into the forced outage unit 28 after the elapse of a time period (the stop period) obtained by subtracting the target value from a period Tx of a burst signal.

For example, as shown in FIG. 1A, in the case where the target value corresponding to the dimming signal has an accumulated value of ON-periods with more than two normal periods and less than three normal periods, the third ON-period Ton(3) is shorter than the normal ON-period Ton(1) or Ton(2). That is, with respect to the third ON-period Ton(3), the accumulated value ΣTon of the ON-periods reaches the target value before the inductor current reaches a peak value ILp, and therefore, the adjusting unit 29 forcibly stops the drive signal outputted by the PWM timer 23. As a result, after the energy stored in the inductor L1 is released at the third ON-period Ton(3), the output of the switching source circuit 1 is stopped and electric power is not supplied to the light source 6. Then, the adjusting unit 29 stops outputting the trigger signal into the forced outage unit 28 after the elapse of the stop period, and the starting unit 21 outputs the set signal, and therefore, the PWM timer 23 restarts outputting the drive signal.

Further, a case is considered where the duty cycle of the dimming signal is reduced by the minimum variation width from the status shown in FIG. 1A. In this case, as shown in FIG. 1B, the target value corresponding to the dimming signal has an accumulated value of ON-periods with substantially equal to two normal periods. Hence, the adjusting unit 29 forcibly stops the drive signal outputted by the PWM timer 23 immediately after the elapse of the second ON-period Ton(2). As a result, after the energy stored in the inductor L1 at the second ON-period Ton(2), is released, the output of the switching source circuit 1 is stopped and electric power is not supplied to the light source 6. Then, the adjusting unit 29 stops outputting the trigger signal into the forced outage unit 28 after the elapse of the stop period, and the starting unit 21 outputs the set signal, and therefore, the PWM timer 23 restarts outputting the drive signal.

Further, a case is considered where the duty cycle of the dimming signal is reduced by the minimum variation width from the status shown in FIG. 1B. In this case, as shown in FIG. 1C, the target value corresponding to the dimming signal has an accumulated value of ON-periods with more than one normal period (that is, more than one normal ON-period) and less than two normal periods. Hence, when with respect to the second ON-period Ton(2), the accumulated value ΣTon of the ON-periods reaches the target value before the inductor current reaches the peak value ILp, the adjusting unit 29 forcibly stops the drive signal outputted by the PWM timer 23. As a result, after the energy stored in the inductor L1 at the second ON-period Ton(2) is released, the output of the switching source circuit 1 is stopped and electric power is not supplied to the light source 6. Then, the adjusting unit 29 stops outputting the trigger signal into the forced outage unit 28 after the elapse of the stop period, and the starting unit 21 outputs the set signal, and therefore, the PWM timer 23 restarts outputting the drive signal.

In the conventional device, even if a duty cycle of the burst dimming is changed during an OFF-period of a switching element, current flowing to an LED does not change. On the other hand, in the present embodiment, the accumulated value of the ON-periods of the switching element Q1 is increased or decreased according to the minimum variation width for the duty cycle, regardless of a timing when the duty cycle (the dimming level) of the dimming signal is changed. Therefore, the lighting system (the LED drive device) according to the present embodiment can change smoothly a light output of a solid-state light-emitting element (the light source 6) with respect to a change in a duty cycle of the burst dimming while preventing the switching frequency from increasing.

Since, in the normal operating state, both of a power-supply voltage from the DC power source E and a voltage applied to the light source 6 are stably maintained, a time period until the detection voltage inputted to the comparator 25 reaches the reference voltage Vref is maintained substantially constant. Hence, also an ON-period until the inductor current reaches the peak value ILp is maintained substantially constant. Therefore, the adjusting unit 29 may use a measured value of at least one ON-period as a representative value and multiply the representative value by a coefficient to estimate the accumulated value, instead of accumulating a measured value per every period, which is measured by ON-period measuring unit 27. In this case, it is preferred that the adjusting unit 29 uses a measured value of the first (the initial) ON-period Ton(1) in the conducting period, as the representative value.

Second Embodiment

Figure 3:
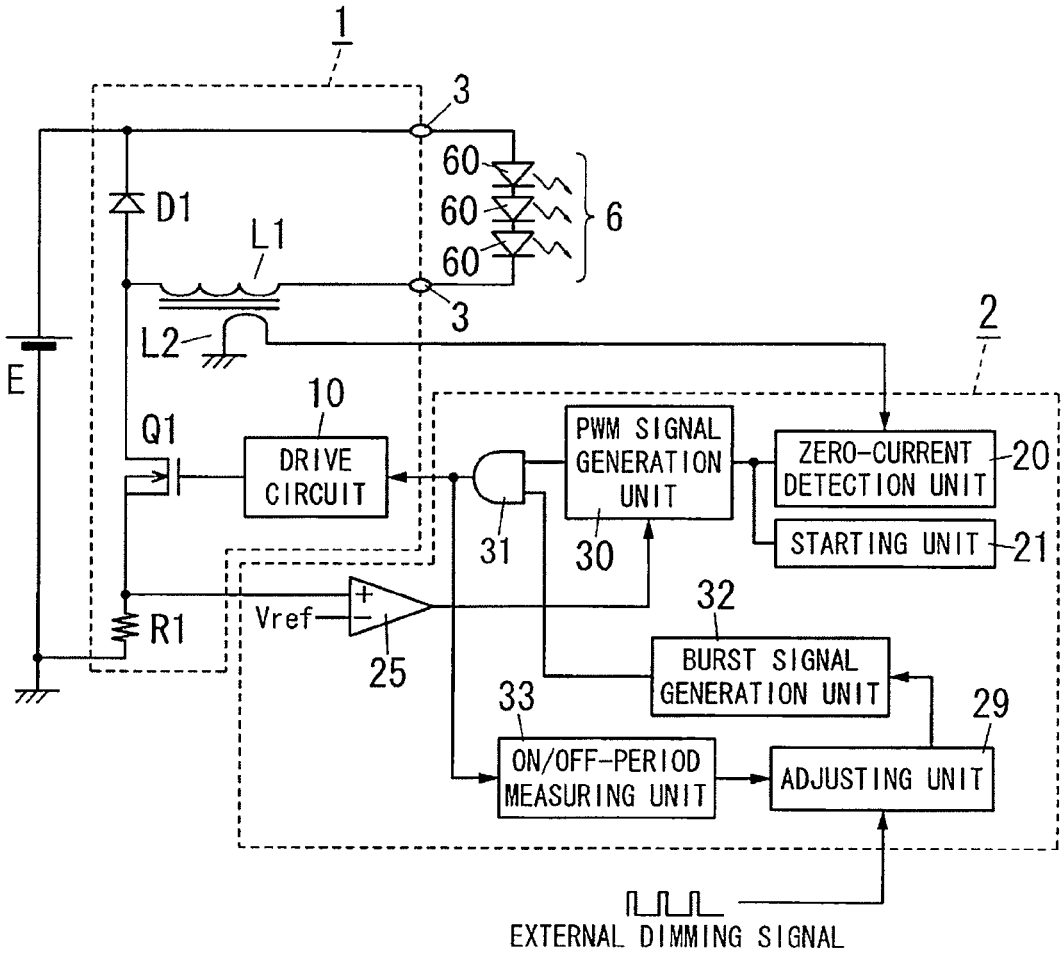
FIG. 3 is a circuit configuration diagram showing a solid-state light-emitting element drive device and a lighting system according to Second Embodiment of the invention.

FIG. 3 shows a circuit configuration diagram of an LED drive device and a lighting system according to the present embodiment. Here, the basic constituent elements of the present embodiment are similar to those of First Embodiment. Therefore, such elements are assigned with same reference numerals and the explanation thereof will be omitted.

A control circuit 2 according to the present embodiment includes a zero-current detection unit 20, a starting unit 21, a comparator 25, an adjusting unit 29, a PWM signal generation unit 30, an AND gate 31, a burst signal generation unit 32, and an ON/OFF-period measuring unit 33.

The PWM signal generation unit 30 outputs the PWM signal when the detection signal is inputted from the zero-current detection unit 20 or the starting signal is inputted from the starting unit 21, and then stops outputting the PWM signal when the output of the comparator 25 becomes the high level.

The AND gate 31 calculates a logical AND of the PWM signal, and the burst signal that is outputted from the burst signal generation unit 32, and then outputs the drive signal into the drive circuit 10, as the calculation result. The ON/OFF-period measuring unit 33 measures a high-level period (an ON-period of the switching element Q1) and a low-level period (an OFF-period of the switching element Q1) of the drive signal outputted from the AND gate 31 individually, and then outputs the measured values into the adjusting unit 29 sequentially.

The adjusting unit 29 calculates an accumulated value of OFF-periods Toff(i) that is required before an accumulated value ΣTon of ON-periods Ton(i) reaches the target value corresponding to the dimming level instructed by the dimming signal, based on each of the measured values of the ON-periods Ton(i) and the OFF-periods Toff(i) measured by the ON/OFF-period measuring unit 33. Further, the adjusting unit 29 calculates the total of the target value and the accumulated value of OFF-periods Toff(i), and then outputs, as an ON-period (a conducting period) of the burst signal, the total value into the burst signal generation unit 32.

The burst signal generation unit 32 generates the burst signal as the PWM signal that has the ON-period equal to the total value outputted from the adjusting unit 29, and then outputs the generated burst signal into the AND gate 31.

Operations according to the present embodiment will be explained. First, there is explained the case where the dimming level instructed by the dimming signal is set to 100% (the rated lighting). The detection signal of the zero-current detection unit 20 or the starting signal of the starting unit 21 is inputted, and then the PWM signal is outputted to from the PWM signal generation unit 30. The adjusting unit 29 outputs the burst signal into the burst signal generation unit 32 so that the ON-period of the burst signal is equal to a period Tz of the burst signal, in the case where the dimming level instructed by the dimming signal is 100%. Therefore, the burst signal generation unit 32 outputs the burst signal, as the output fixed at the high level, into the AND gate 31. The AND gate 31 outputs the drive signal that is synchronized with the PWM signal. Then, the drive circuit 10 turns on the switching element Q1 so as to be synchronized with the drive signal outputted from the AND gate 31. When the switching element Q1 is turned on, the current (the inductor current) flows through the DC power source E, the light source 6, the inductor L1, the switching element Q1, the sensing resistor R1 and the DC power source E in that order.

Then, when the inductor current reaches the predetermined peak value ILp, the output of the comparator 25 becomes the high level, and therefore, the PWM signal generation unit 30 stops outputting the drive signal. As a result, the switching element Q1 is turned off and the energy stored in the inductor L1 is released, and therefore, the current (the inductor current) continues to flow to the light source 6 via the diode D1.

When the energy stored in the inductor L1 is all released and the inductor current is reduced to zero, the detection signal is outputted from the zero-current detection unit 20, and the PWM signal is outputted from the PWM signal generation unit 30. Hence, the switching element Q1 is turned on again due to the PWM signal outputted from the PWM signal generation unit 30. In this way, the switching operation of the switching element Q1 is performed at a constant period (a switching period), and the switching source circuit 1 supplies a rated direct-current (an average value) to the light source 6.

Next, a case is explained where the dimming level instructed by the dimming signal is set to less than 100%. In this case, the control circuit 2 adopts the Burst Dimming Method as First Embodiment. That is, the control circuit 2 interrupts periodically the output of the switching source circuit 1, thereby adjusting an average value of the current flowing to the light source 6 to a value corresponding to the dimming level.

The adjusting unit 29 calculates an accumulated value of OFF-periods Toff(i) that is required before an accumulated value ΣTon of ON-periods Ton(i) reaches the target value corresponding to the dimming level instructed by the dimming signal, based on each of the measured values of the ON-periods Ton(i) and the OFF-periods Toff(i) measured by the ON/OFF-period measuring unit 33. Further, the adjusting unit 29 calculates the total of the target value (=the accumulated value ΣTon of the ON-periods Ton(i)) and the accumulated value of the OFF-periods Toff(i), and then outputs, as the ON-period (the conducting period) of the burst signal, the total value into the burst signal generation unit 32. The burst signal generation unit 32 generates the burst signal that has the ON-period equal to the total value outputted from the adjusting unit 29, and then outputs the generated burst signal into the AND gate 31. The AND gate 31 outputs the drive signal when both of the burst signal and the PWM signal become the high levels.

When the accumulated value of the ON-periods Ton(i) within the conducting period reaches the target value, the burst signal falls to the low level after the elapse of the last ON-period Ton(m). Therefore, the output of the AND gate 31 is fixed at the low level, and the output of the drive signal is stopped. After the elapse of the OFF-period (the stop period), the burst signal rises, and at the same time, the starting unit 21 outputs the set signal. As a result, the output of the AND gate 31 rises to the high level, and the drive signal is outputted again.

Figure 4A:
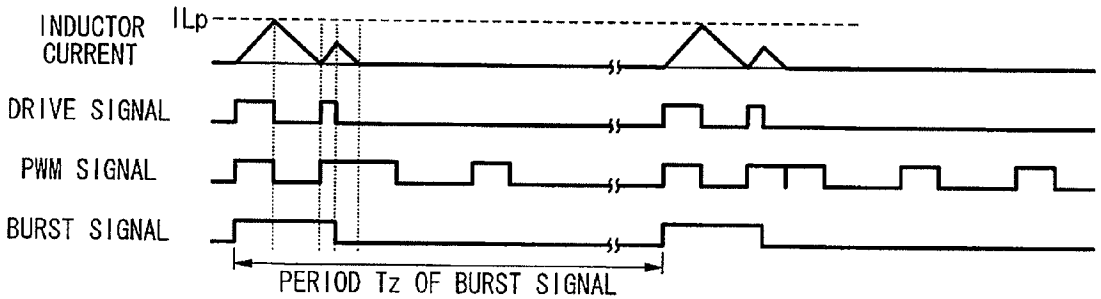
FIGS. 4A to 4C are waveform diagrams for explaining operations of the solid-state light-emitting element drive device and the lighting system according to Second Embodiment of the invention.

For example, as shown in FIG. 4A, it is assumed that the target value corresponding to the dimming signal has an accumulated value of ON-periods more than one normal period (that is, more than one normal ON-period) and less than two normal periods. In this case, because the ON-period (the conducting period) of the burst signal ends in the middle of the second period, the output of the AND gate 31 becomes the low level and the output of the drive signal is stopped before the inductor current reaches the peak value ILp in the second period. As a result, after the energy stored in the inductor L1 at the second ON-period Ton(2) is released, the output of the switching source circuit 1 is stopped and electric power is not supplied to the light source 6. Then, after the elapse of the OFF-period (the stop period) of the burst signal, the burst signal rises, and at the same time, the starting unit 21 outputs the set signal. Therefore, the output of the AND gate 31 rises to the high level, and the drive signal is outputted again.

Figure 4B:
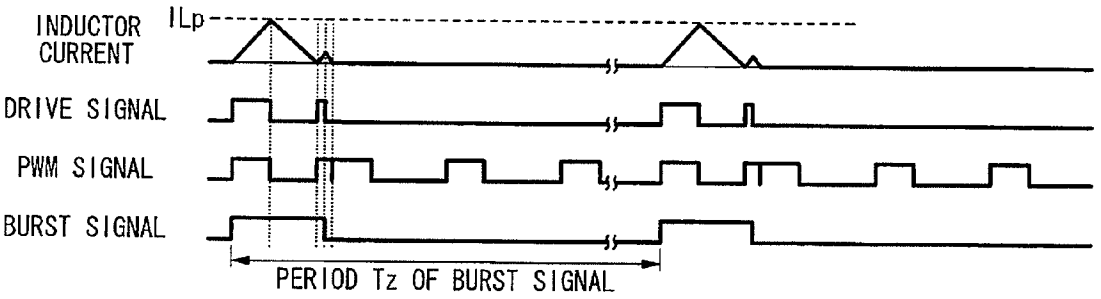

Further, it is assumed that the duty cycle of the dimming signal is reduced by the minimum variation width from the status shown in FIG. 4A. Here, as shown in FIG. 4B, it is assumed that the target value corresponding to the dimming signal has an accumulated value of ON-periods more one normal period (that is, more than one normal ON-period) and less than two normal periods. In this case, since the ON-period (the conducting period) of the burst signal ends in the middle of the second period, the output of the AND gate 31 becomes the low level and the output of the drive signal is stopped before the inductor current reaches the peak value ILp in the second period. As a result, after the energy stored in the inductor L1 at the second ON-period Ton(2) is released, the output of the switching source circuit 1 is stopped and electric power is not supplied to the light source 6. Then, after the elapse of the OFF-period (the stop period) of the burst signal, the burst signal rises, and at the same time, the starting unit 21 outputs the set signal. Therefore, the output of the AND gate 31 rises to the high level, and the drive signal is outputted again.

Figure 4C:
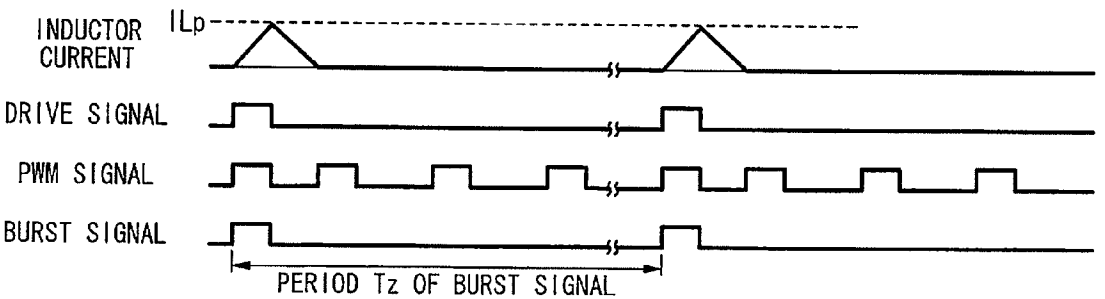
Figure 5A:
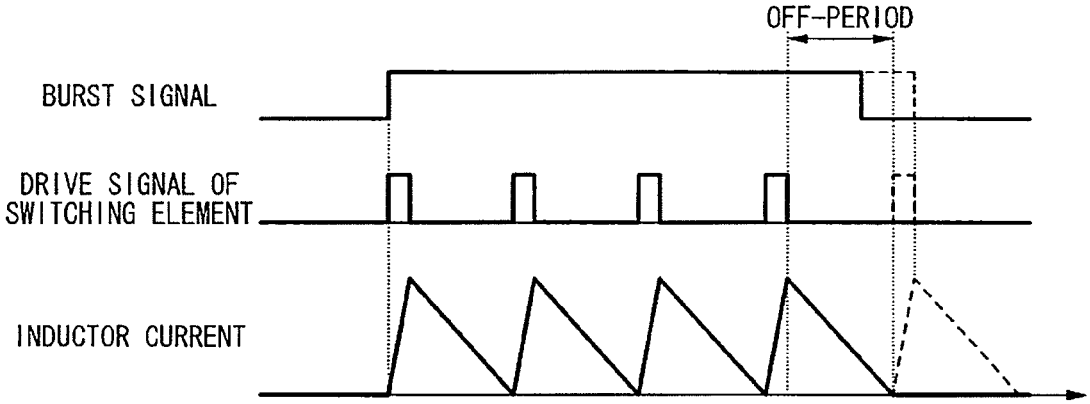
FIGS. 5A and 5B are waveform diagrams for explaining operations of a conventional example.
Figure 5B:
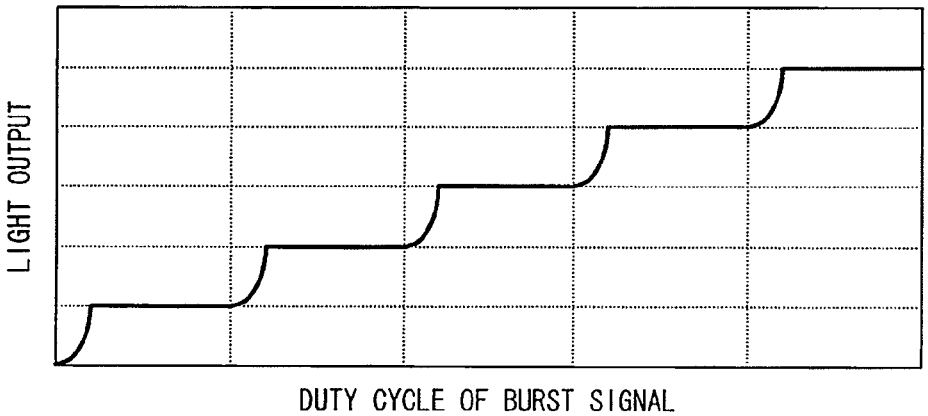

Further, it is assumed that the duty cycle of the dimming signal is reduced by the minimum variation width from the status shown in FIG. 4B. Here, as shown in FIG. 4C, it is assumed that the target value corresponding to the dimming signal has an accumulated value of ON-periods substantially equal to one normal period (that is, equal to one normal ON-period). In this case, the termination of the ON-period of the burst signal is synchronized with the termination of the ON-period Ton(1) in the first period, and the output of the AND gate 31 becomes the low level and the output of the drive signal is stopped after the elapse of the first ON-period Ton(1). As a result, after the energy stored in the inductor L1 at the first ON-period Ton(1) is released, the output of the switching source circuit 1 is stopped and electric power is not supplied to the light source 6. Then, after the elapse of the OFF-period (the stop period) of the burst signal, the burst signal rises, and at the same time, the starting unit 21 outputs the set signal. Therefore, the output of the AND gate 31 rises to the high level, and the drive signal is outputted again.

As described above, in the present embodiment, the ON-period (the duty cycle) of the burst signal is increased or decreased so that the accumulated value of the ON-periods of the switching element Q1 is increased or decreased according to the minimum variation width for the duty cycle, regardless of a timing when the duty cycle (the dimming level) of the dimming signal is changed. Therefore, the lighting system (the LED drive device) according to the present embodiment can also change smoothly a light output of a solid-state light-emitting element (the light source 6) with respect to a change in a duty cycle of the burst dimming while preventing the switching frequency from increasing, as well as First Embodiment.

In the normal operating state, since both of a power-supply voltage from the DC power source E and a voltage applied to the light source 6 are stably maintained, a time period until the detection voltage inputted to the comparator 25 reaches the reference voltage Vref is maintained substantially constant. Hence, an ON-period Ton until the inductor current reaches the peak value ILp, and an OFF-period Toff during which the inductor current is reduced from the peak value ILp to zero are also maintained substantially constant. Therefore, using measured values of at least one ON-period Ton and an OFF-period Toff following the at least one ON-period Ton (e.g., measured values of the first (the initial) ON-period Ton(1) and the first (the initial) OFF-period Toff(1) in the conducting period), as representative values, the adjusting unit 29 may estimate the ON-period (the conducting period) of the burst signal from the representative values.

For example, when the target value for the accumulated value of the ON-periods Ton corresponding to the dimming level is denoted by "ΣTon" and the representative values for the ON-periods Ton and the OFF-periods Toff are respectively denoted by "Ton(*)" and "Toff(*)", the ON-period (the conducting period) Tburst of the burst signal can be calculated by using the following formula, where "ing[m/n]" is defined as a quotient (an integer) of a value obtained by dividing a numerical value "m" by a numerical value "n".

$$T\text{burst}=\Sigma T\text{on}+\text{int}[\Sigma T\text{on}/T\text{on}(*)]\times T\text{off}(*)$$

Further, in the above-mentioned First and Second Embodiments, a step-down chopper circuit in which the critical current control is performed is illustrated as one example of the switching source circuit 1. However, the circuit configuration of the switching source circuit 1 is not limited to the step-down chopper circuit in which the critical current control is performed. Further, instead of the DC power source E, an AC power source and an AC/DC converter may be used. In this case, the AC/DC converter converts an AC voltage/an AC, supplied from the AC power source, into a DC voltage/a DC.

Here, although not shown in the Figures, a lighting fixture can be achieved by holding the LED drive device and the light source 6 according to any one of First and Second Embodiments through the lighting fixture body. As such a lighting fixture, a down-light, a ceiling-light or a head-light of a vehicle can be achieved for example.

As explained above, a solid-state light-emitting element drive device comprises: a switching source circuit 1 in which a solid-state light-emitting element is connected between output terminals 3 of the switching source circuit 1; and a control circuit 2. The switching source circuit 1 comprises a switching element Q1. The control circuit 2 is configured to control switching operation of the switching element Q1 of the switching source circuit 1. The switching source circuit 1 further comprises an inductor L1 and a regenerative element (it corresponds to a diode D1). The switching element Q1 and the inductor L1 constitute a series circuit. The regenerative element is configured to make a regenerative current flow from the inductor L1, when the switching element Q1 is turned off. The control circuit 2 comprises a microcomputer. The control circuit 2 is configured to turn on the switching element Q1 in response to an ON-period of a drive signal outputted from the microcomputer. The control circuit 2 is configured to turn off the switching element Q1 in response to an OFF-period of the drive signal. The control circuit 2 is configured to interrupt periodically output of the switching source circuit 1 to adjust an average value of current flowing to the solid-state light-emitting element to a value corresponding to a dimming level instructed from outside. The control circuit 2 is configured to perform the switching operation of the switching element Q1 during a conducting period. The control circuit 2 is configured to stop the switching operation of the switching element Q1 during a stop period following the conducting period. The control circuit 2 is configured to alternately repeat the conducting period and the stop period, while increasing or decreasing the conducting period and the stop period in response to the dimming level. The control circuit 2 is configured to adjust an accumulated value of ON-periods of the drive signal within the conducting period, in response to the dimming level, and to set a minimum variation width for the conducting period to be shorter than the ON-period (that is, a normal ON-period during which the inductor current rises from zero to the peak value ILp).

In the solid-state light-emitting element drive device, the control circuit 2 monitors the accumulated value of the ON-periods. The control circuit 2 stops the switching operation of the switching element Q1 when the accumulated value reaches a target value.

In the solid-state light-emitting element drive device, the control circuit 2 estimates the accumulated value from at least one of the ON-periods.

In the solid-state light-emitting element drive device, the control circuit 2 estimates the accumulated value from an initial ON-period of the ON-periods in the conducting period.

In the solid-state light-emitting element drive device, the control circuit 2 further comprises a burst signal generation unit 32, a PWM signal generation unit 30, a drive signal generation unit (it corresponds to an AND gate 31), and an adjusting unit 29. The burst signal generation unit 32 is configured to generate a burst signal in which a ratio between the conducting period and the stop period is variable. The burst signal includes a pulse signal with a constant period that is synchronized with the conducting period and the stop period. The PWM signal generation unit 30 is configured to generate a pulse-width modulation signal (a PWM signal) in which a period and a width of an ON-period thereof are variable. The pulse-width modulation signal has a frequency higher than the burst signal. The drive signal generation unit is configured to calculate a logical AND of the burst signal and the PWM signal to generate a drive signal for driving the switching element Q1. The adjusting unit 29 is configured to adjust the ratio of the burst signal generated by the burst signal generation unit 32, based on the dimming level.

In the solid-state light-emitting element drive device, the adjusting unit 29 calculates the ratio of the burst signal from an accumulated value of the ON-periods and OFF periods of the signal within the conducting period.

In the solid-state light-emitting element drive device, the adjusting unit 29 estimates the accumulated value from at least one of the ON-periods and an OFF-period following at least one of the ON-periods.

In the solid-state light-emitting element drive device, the adjusting unit 29 estimates the accumulated value from an initial ON-period and an initial OFF period following the initial ON-period in the conducting period.

In the solid-state light-emitting element drive device, the microcomputer have a timer built-in. The timer clocks the conducting period and the stop period.

As explained above, a lighting system comprises: any one of the above-mentioned solid-state light-emitting element drive devices; and a solid-state light-emitting element driven by the solid-state light-emitting element drive device.

As explained above, a lighting fixture comprises: any one of the above-mentioned solid-state light-emitting element drive devices; a solid-state light-emitting element driven by the solid-state light-emitting element drive device; and a fixture body holding the solid-state light-emitting element drive device and the solid-state light-emitting element.

Although the present invention has been described with reference to certain preferred embodiments, numerous modifications and variations can be made by those skilled in the art without departing from the true spirit and scope of this invention, namely claims.

The invention claimed is:

1. A solid-state light-emitting element drive device, comprising:

a switching source circuit in which a solid-state light-emitting element is connected between output terminals of the switching source circuit, the switching source circuit comprising a switching element; and a control circuit configured to control switching operation of the switching element of the switching source circuit, wherein the switching source circuit further comprises an inductor and a regenerative element, the switching element and the inductor constituting a series circuit, the regenerative element configured to make a regenerative current flow from the inductor, when the switching element is turned off, wherein the control circuit comprises a microcomputer, the control circuit configured to turn on the switching element in response to an ON-period of a drive signal outputted from the microcomputer, the control circuit configured to turn off the switching element in response to an OFF-period of the drive signal, the control circuit configured to interrupt periodically output of the switching source circuit to adjust an average value of current flowing to the solid-state light-emitting element to a value corresponding to a dimming level instructed from outside, and wherein the control circuit is configured to perform the switching operation of the switching element during a conducting period, the control circuit being configured to stop the switching operation of the switching element during a stop period following the conducting period, the control circuit being configured to alternately repeat the conducting period and the stop period, while increasing or decreasing the conducting period and the stop period in response to the dimming level, the control circuit being configured to adjust an accumulated value of ON-periods of the drive signal within the conducting period, in response to the dimming level, and to set a minimum variation width for the conducting period to be shorter than the ON-period.

2. The solid-state light-emitting element drive device according to claim 1, wherein the control circuit monitors the accumulated value of the ON-periods, the control circuit stopping the switching operation of the switching element when the accumulated value reaches a target value.

3. The solid-state light-emitting element drive device according to claim 1, wherein the control circuit estimates the accumulated value from at least one of the ON-periods.

4. The solid-state light-emitting element drive device according to claim 3, wherein the control circuit estimates the accumulated value from an initial ON-period of the ON-periods in the conducting period.

5. The solid-state light-emitting element drive device according to claim 1, wherein the control circuit further comprises:

a burst signal generation unit configured to generate a burst signal in which a ratio between the conducting period and the stop period is variable, the burst signal including a pulse signal with a constant period that is synchronized with the conducting period and the stop period;

a PWM signal generation unit configured to generate a pulse-width modulation signal in which a period and a width of an ON-period thereof are variable, the pulse-width modulation signal having a frequency higher than the burst signal;

a drive signal generation unit configured to calculate a logical AND of the burst signal and the PWM signal to generate a drive signal for driving the switching element; and an adjusting unit configured to adjust the ratio of the burst signal generated by the burst signal generation unit, based on the dimming level.

6. The solid-state light-emitting element drive device according to claim 5, wherein the adjusting unit calculates the ratio of the burst signal from an accumulated value of the ON-periods and OFF periods of the signal within the conducting period.

7. The solid-state light-emitting element drive device according to claim 6, wherein the adjusting unit estimates the accumulated value from at least one of the ON-periods and an OFF-period following at least one of the ON-periods.

8. The solid-state light-emitting element drive device according to claim 7, wherein the adjusting unit estimates the accumulated value from an initial ON-period and an initial first OFF period following the initial ON-period in the conducting period.

9. The solid-state light-emitting element drive device according to claim 1, wherein the microcomputer have a timer built-in, the timer clocking the conducting period and the stop period.

10. A lighting system, comprising:

the solid-state light-emitting element drive device according to claim 1; and a solid-state light-emitting element driven by the solid-state light-emitting element drive device.

11. A lighting fixture, comprising:

the solid-state light-emitting element drive device according to claim 1;

a solid-state light-emitting element driven by the solid-state light-emitting element drive device; and a fixture body holding the solid-state light-emitting element drive device and the solid-state light-emitting element.

* * * * *